US009503805B2

(12) United States Patent
Huang et al.

(10) Patent No.: US 9,503,805 B2
(45) Date of Patent: Nov. 22, 2016

(54) PIEZOELECTRIC CERAMIC DUAL-FREQUENCY EARPHONE STRUCTURE

(71) Applicant: Jetvox Acoustic Corp., Taoyuan (TW)

(72) Inventors: To-Teng Huang, Taoyuan (TW); Ming-Fang Hung, Taoyuan (TW)

(73) Assignee: JETVOX ACOUSTIC CORP., Taoyuan (TW)

( * ) Notice: Subject to any disclaimer, the term of this patent is extended or adjusted under 35 U.S.C. 154(b) by 37 days.

(21) Appl. No.: 14/616,169

(22) Filed: Feb. 6, 2015

(65) Prior Publication Data

US 2016/0127820 A1 May 5, 2016

(30) Foreign Application Priority Data

Oct. 31, 2014 (TW) ..... 103219382 U

(51) Int. Cl.

| | |
|---|---|
| ***H04R 1/24*** | (2006.01) |
| ***H04R 1/10*** | (2006.01) |
| ***H04R 1/26*** | (2006.01) |
| ***H04R 17/00*** | (2006.01) |
| *H04R 9/06* | (2006.01) |

(52) U.S. Cl.

CPC *H04R 1/24* (2013.01); *H04R 1/10* (2013.01); *H04R 1/1091* (2013.01); *H04R 1/26* (2013.01); *H04R 17/00* (2013.01); *H04R 9/06* (2013.01); *H04R 2217/00* (2013.01)

(58) Field of Classification Search

CPC ..... H04R 1/1091; H04R 1/20; H04R 1/22; H04R 1/225; H04R 1/24; H04R 1/26; H04R 9/06; H04R 9/063; H04R 17/00; H04R 23/02; H04R 2205/022

See application file for complete search history.

(56) References Cited

U.S. PATENT DOCUMENTS

| | | | | |
|---|---|---|---|---|
| 3,943,304 A * | 3/1976 | Piribauer | H04R 1/24 | 381/182 |
| 4,122,315 A * | 10/1978 | Schroeder | H04R 1/24 | 181/147 |
| 4,379,951 A * | 4/1983 | Gabr | H04N 5/642 | 181/161 |
| 4,418,248 A * | 11/1983 | Mathis | H04R 1/26 | 381/190 |
| 4,492,826 A * | 1/1985 | Chiu | H04R 1/24 | 181/144 |

(Continued)

FOREIGN PATENT DOCUMENTS

| | | |
|---|---|---|
| JP | 08-088896 | 4/1996 |
| JP | 2004-147077 | 5/2004 |

(Continued)

*Primary Examiner* — Curtis Kuntz
*Assistant Examiner* — Joshua Kaufman
(74) *Attorney, Agent, or Firm* — Muncy, Geissler, Olds & Lowe, P.C.

(57) ABSTRACT

A piezoelectric ceramic dual-frequency earphone structure includes an earphone housing, a dynamic transducer, a piezoelectric ceramic transducer and a circuit board. The piezoelectric ceramic transducer is installed in the receiving region. The piezoelectric ceramic transducer is connected to the dynamic transducer via a support unit and a positioning unit. The circuit board is assembled in the receiving region and connected to acoustic signal cables. The acoustic signal cables are connected to a dynamic voice coil of the dynamic transducer and the piezoelectric ceramic transducer. When electric signals are applied to a ceramic membrane of the piezoelectric ceramic transducer, a metal sheet of the piezoelectric ceramic transducer is vibrated to generate high frequency sound, and the high frequency sound are then mixed with the sound from the dynamic transducer.

9 Claims, 4 Drawing Sheets

(56) References Cited

U.S. PATENT DOCUMENTS 4,497,981 A * 2/1985 House ..... H04R 23/02 181/144
4,552,242 A * 11/1985 Kashiwabara ..... H04R 1/24 181/144
4,554,414 A * 11/1985 House ..... H04R 1/24 181/144
4,727,586 A * 2/1988 Johnson ..... H04R 1/26 381/182
4,965,836 A * 10/1990 Andre ..... H04R 1/1008 181/129
4,965,837 A * 10/1990 Murayama ..... H04R 1/24 181/144
5,193,119 A * 3/1993 Tontini ..... H04R 1/24 381/182
5,430,803 A * 7/1995 Kimura ..... H04R 1/46 381/190
5,739,480 A * 4/1998 Lin ..... H04R 9/06 181/144
6,269,168 B1 * 7/2001 Tagami ..... H04R 9/025 381/401
2003/0165249 A1 * 9/2003 Higuchi ..... H04R 9/063 381/318
2003/0206641 A1 * 11/2003 Peng ..... H04R 1/24 381/182
2004/0037441 A1 * 2/2004 Konishi ..... H04M 1/03 381/190
2004/0047478 A1 * 3/2004 Combest ..... H04R 1/24 381/182
2005/0069166 A1 * 3/2005 Peng ..... H04R 1/24 381/401
2005/0276438 A1 * 12/2005 Kobayashi ..... H04R 1/24 381/433
2006/0262954 A1 * 11/2006 Lee ..... H04M 1/03 381/380
2009/0003632 A1 * 1/2009 Lin ..... H04R 9/025 381/182
2009/0046876 A1 * 2/2009 Reck ..... H04R 1/24 381/184
2009/0116676 A1 * 5/2009 Welsh ..... H04R 1/24 381/380
2009/0196442 A1 * 8/2009 Eaton ..... H04R 17/00 381/190
2009/0279729 A1 * 11/2009 Huang ..... H04R 1/1016 381/345
2010/0046783 A1 * 2/2010 Huang ..... H04R 1/1075 381/380
2012/0057730 A1 * 3/2012 Fujise ..... H04R 17/00 381/190
2012/0148086 A1 * 6/2012 Tanabe ..... H04R 1/24 381/401
2012/0163637 A1 * 6/2012 Chen ..... H04R 1/24 381/184
2013/0016867 A1 * 1/2013 Xi ..... H04R 1/1016 381/374
2013/0170675 A1 * 7/2013 Saint Vincent ..... H04R 3/00 381/190
2013/0195293 A1 * 8/2013 Ko ..... H04R 19/02 381/191
2014/0044301 A1 * 2/2014 Zhang ..... H04R 1/02 381/388
2014/0056436 A1 * 2/2014 Kim ..... H04R 1/24 381/71.7
2014/0169583 A1 * 6/2014 Huang ..... H04R 1/24 381/74
2014/0363035 A1 * 12/2014 Zhao ..... H04R 9/04 381/182
2014/0363041 A1 * 12/2014 Zhao ..... H04R 1/00 381/414
2015/0373460 A1 * 12/2015 Huang ..... H04R 1/02 381/190
2016/0044405 A1 * 2/2016 Huang ..... H04R 1/1075 381/74
2016/0119720 A1 * 4/2016 Doshida ..... H04R 1/2811 381/190
2016/0119721 A1 * 4/2016 Doshida ..... H04R 1/1075 381/190
2016/0127820 A1 * 5/2016 Huang ..... H04R 1/10 381/380

FOREIGN PATENT DOCUMENTS

JP 3193281 9/2014
KR 10-2005-0033438 4/2005
KR 10-2014-0077101 6/2014

* cited by examiner

PIEZOELECTRIC CERAMIC DUAL-FREQUENCY EARPHONE STRUCTURE

CROSS-REFERENCES TO RELATED APPLICATIONS

This non-provisional application claims priority under 35 U.S.C. §119(a) on Patent Application No. 103219382 filed in Taiwan, R.O.C. on Oct. 31, 2014, the entire contents of which are hereby incorporated by reference.

BACKGROUND

Technical Field

The instant disclosure relates to earphones, and more particular to a piezoelectric ceramic dual-frequency earphone structure having a dynamic transducer and a composite piezoelectric sheet.

Related Art

Most parity price earphone are classified as dynamic earphone in which a winded cylinder coil in a permanent magnetic field is connected with a vibrating diaphragm, and the coil is driven by currents to actuate the vibration of the vibrating diaphragm for the sound generation. Generally, a conventional dynamic earphone includes a housing, a vibrating diaphragm, a permanent magnet, a magnet conductive member, a fastening member and a voice coil. when sound are sent to the voice coil through an acoustic transmitting cable of the dynamic earphone, the voice coil generates an inductive magnetic field because of the electromagnetic effect, so that the inductive magnetic field interacts with the magnetic force generated by the magnet conductive member so as to push the vibrating diaphragm to vibrate, and the vibration of the medium is then converted into sound for output.

The conventional dynamic earphone has a single vibrating diaphragm for generating high and low sound simultaneously. The advantages of the conventional are lower cost and wider resolute frequency bands. While, one of the drawbacks of the conventional is, the single vibrating diaphragm is disable to separate the sound according to the frequencies, resulting in the deficiency for performing the sound resolution, the response positions and spatial resolutions clearly, especially for the high frequency bands. While an earphone utilizing low frequency voice coil along with high frequency voice coil is market available, the earphone has one vibrating diaphragm and failed to perform clear sound resolution.

SUMMARY

In view of this, the instant disclosure provides a piezoelectric ceramic dual-frequency earphone structure comprising an earphone housing, a dynamic transducer, a piezoelectric ceramic transducer and a circuit board. The earphone housing comprises a case and a cover. The case defines a receiving region and a sound output region. The dynamic transducer, the piezoelectric ceramic transducer and the circuit board are installed in the receiving region. The piezoelectric effect of the piezoelectric ceramic transducer allows the piezoelectric ceramic transducer to vibrate for the generation of high frequency sound so as to compensate the deficiency of the dynamic transducer in generating high frequency sound.

The dynamic transducer comprises a vibrating member, a positioning unit, a dynamic voice coil and a vibrating diaphragm. The vibrating diaphragm comprises a central vibrating portion. the vibrating member comprises an annular magnet and a washer. The positioning unit comprises a yoke assembly and a positioning base. The yoke assembly is assembled with at least one latch member configured on an inner wall of the case. The vibrating member is riveted with the yoke assembly. The positioning base is adapted on the yoke assembly to position the vibrating diaphragm. The dynamic voice coil is configured on a lower surface of the vibrating diaphragm and sleeved with the vibrating member.

The dynamic transducer further comprises a sound transmitting member disposed on the vibrating member. The sound transmitting member is riveted and connected with the vibrating member. The sound transmitting member defines a sound transmitting hole corresponding to the central vibrating portion. The piezoelectric ceramic transducer is connected with the yoke assembly via a support unit. The circuit board is assembled within the yoke assembly for connecting to a plurality of acoustic signal cables, so that the acoustic signal cables are connected with the dynamic voice coil and the piezoelectric ceramic transducer. The piezoelectric ceramic dual-frequency earphone structure further comprises an acoustic signal cable guiding portion for guiding the acoustic signal cables into the receiving region.

The piezoelectric ceramic transducer is a composite piezoelectric sheet comprising a metal sheet and at least one ceramic membrane. The ceramic membrane is disposed at a surface of the metal sheet or disposed at the two surfaces of the metal sheet. When two ceramic membranes are disposed at the two surfaces of the metal sheet, respectively, the positive terminal and the negative terminal of the acoustic signal cables are respectively connected to at least one of the ceramic membranes and the metal sheet.

Accordingly, the advantages of the instant disclosure are described as below. When electric signals are applied to the ceramic membrane of the piezoelectric ceramic transducer, the metal sheet is vibrated so as to generate high frequency sound, and the high frequency sound are then mixed with the sound from the dynamic transducer, so that the piezoelectric ceramic dual-frequency earphone structure according to the instant disclosure performs clear sound resolution for high frequency bands compared to conventional earphone with single vibrating diaphragm. Moreover, the instant disclosure performs better sound resolution, lower energy consumption and better sustainability.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
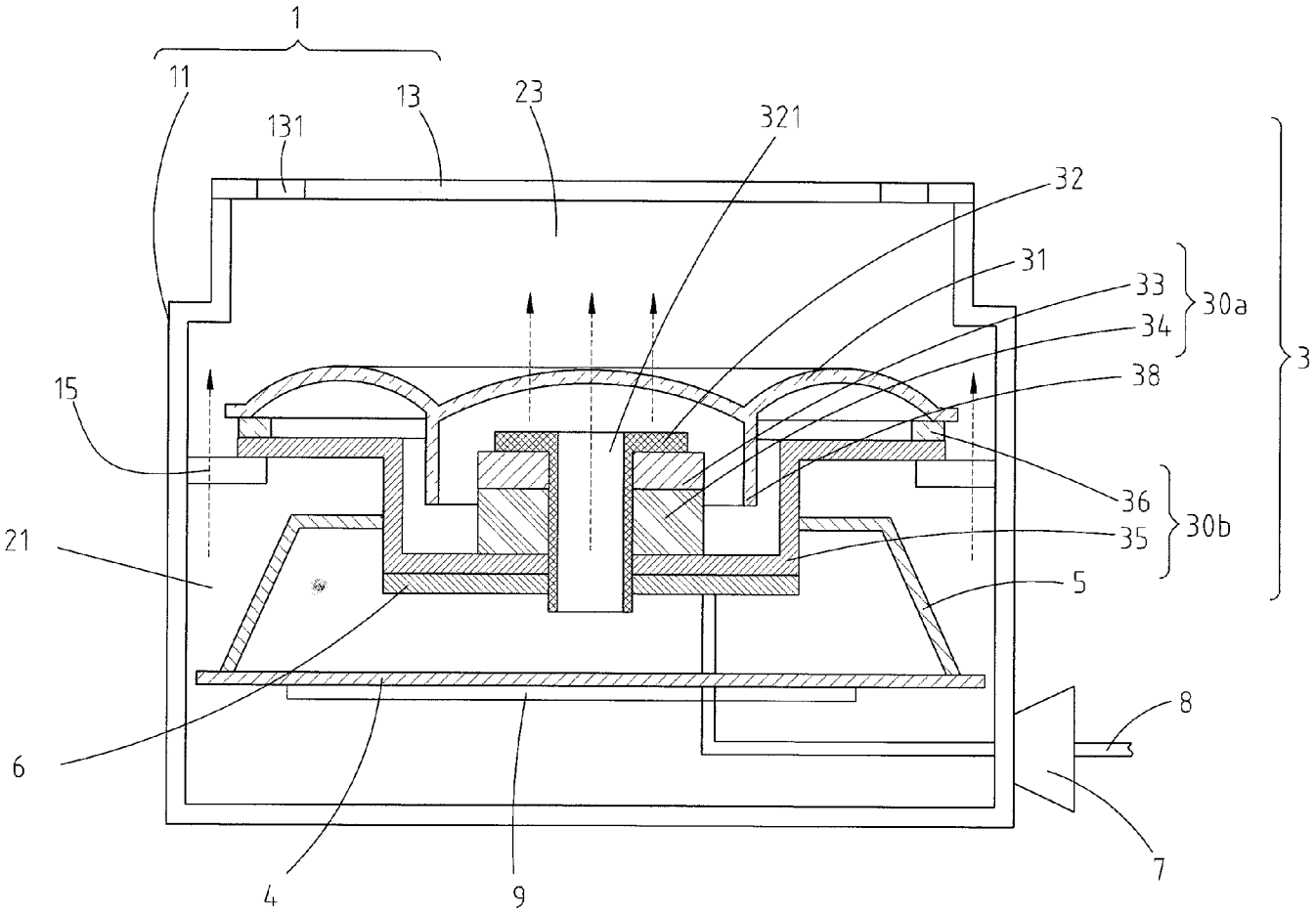
FIG. 1 is a sectional view of an exemplary embodiment of a piezoelectric ceramic dual-frequency earphone structure according to the instant disclosure.

Please refer to FIG. 1, illustrating a sectional view of an exemplary embodiment of a piezoelectric ceramic dual-frequency earphone structure according to the instant disclosure. The piezoelectric ceramic dual-frequency earphone structure comprises an earphone housing 1, a dynamic transducer 3, a piezoelectric ceramic transducer 4 and a circuit board 6. The earphone housing 1 comprises a case 11 and a cover 13, the case 11 defines a receiving region 21 and a sound output region 23. The cover 13 is connected to the case 11 to cover the sound output region 23. At least one latch member 15 is configured on (for example, protruded from or assembled to) an inner wall of the case 11. The dynamic transducer 3, the piezoelectric ceramic transducer 4 and the circuit board 6 are installed in the receiving region 21.

Figure 2:
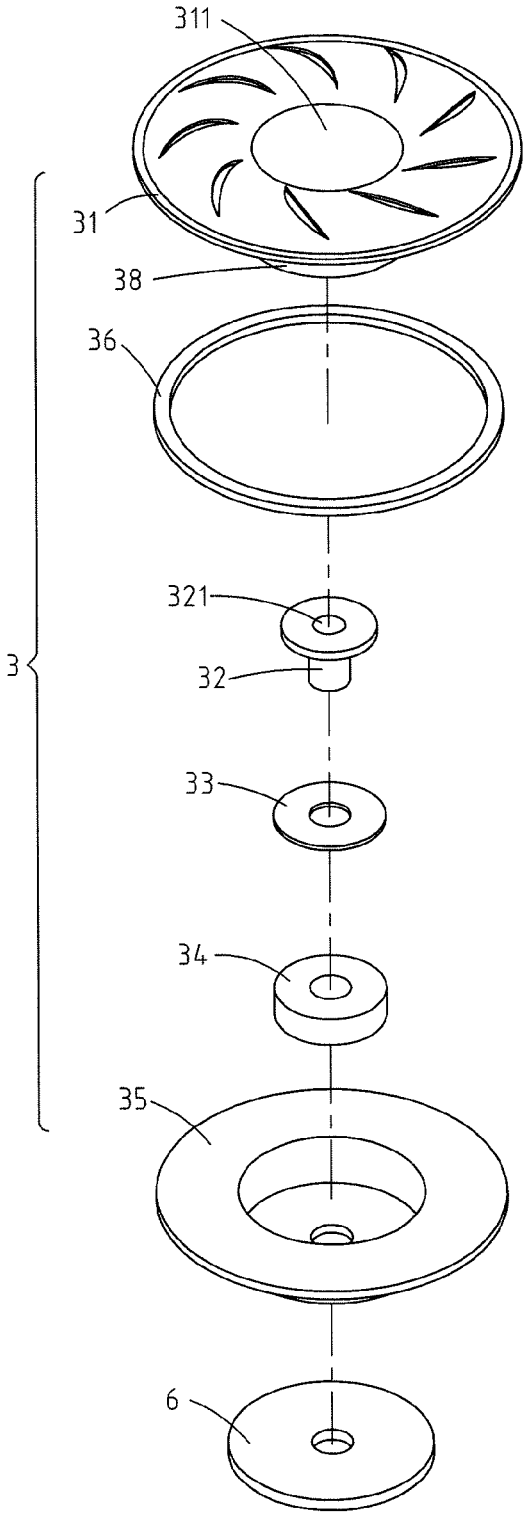
FIG. 2 is an exploded view of a dynamic transducer of the piezoelectric ceramic dual-frequency earphone structure according to the instant disclosure.

Please refer to FIG. 2, illustrating an exploded view of a dynamic transducer 3 of the piezoelectric ceramic dual-frequency earphone structure according to the instant disclosure. As shown in FIG. 1 and FIG. 2, the dynamic transducer 3 comprises a vibrating member 30*a*, a positioning unit 30*b*, a vibrating diaphragm 31 and a dynamic voice coil 38. The vibrating diaphragm 31 comprises a central vibrating portion 311. A center of the vibrating member 30*a* corresponds to the central vibrating portion 311. The vibrating member 30*a* comprises an annular magnet 34 and a washer 33 placed on the surface of the annular magnet 34. The positioning unit 30*b* comprises a yoke assembly 35 and a positioning base 36. The yoke assembly 35 is assembled with the at least one latch member 15, and the vibrating member 30*a* is riveted with the yoke assembly 35. The positioning base 36 is adapted on the yoke assembly 35 to position the vibrating diaphragm 31. The dynamic voice coil 38 is configured on a lower surface of the vibrating diaphragm 31 and sleeved with the vibrating member 30*a*.

The dynamic transducer 3 further comprises a sound transmitting member 32 disposed on the vibrating member 30*a*. The sound transmitting member 32 is riveted and connected with the vibrating member 30*a*. The sound transmitting member 32 defines a sound transmitting hole 321 corresponding to the central vibrating portion 311.

The piezoelectric ceramic transducer 4 is connected with the yoke assembly 35 via a support unit 5. The circuit board 6 is assembled within the yoke assembly 35 for connecting to a plurality of acoustic signal cables 8, so that the acoustic signal cables 8 are connected with the dynamic voice coil 38 and the piezoelectric ceramic transducer 4. Furthermore, the piezoelectric ceramic dual-frequency earphone structure according to the instant disclosure further comprises an acoustic signal cable guiding portion 7 connected to and communicating with the case 11 so as to guide the acoustic signal cables 8 into the receiving region 21.

Please refer to FIG. 1 again, in which a buffer material 9 is placed on at least one surface of the piezoelectric ceramic transducer 4. The buffer material 9 can be made of ceramics, metals or polymer materials for adjusting the sound frequency generated from the piezoelectric ceramic transducer 4. As shown in FIG. 1, the medium and low frequency sound generated by the vibrating diaphragm 31 is transmitted to the sound output region 23. The dynamic transducer 3 is located between the cover 13 and the piezoelectric ceramic transducer 4. The high frequency sound generated by the piezoelectric ceramic transducer 4 is transmitted into the sound output region 23 via the sides of the dynamic transducer 3.

Figure 3:
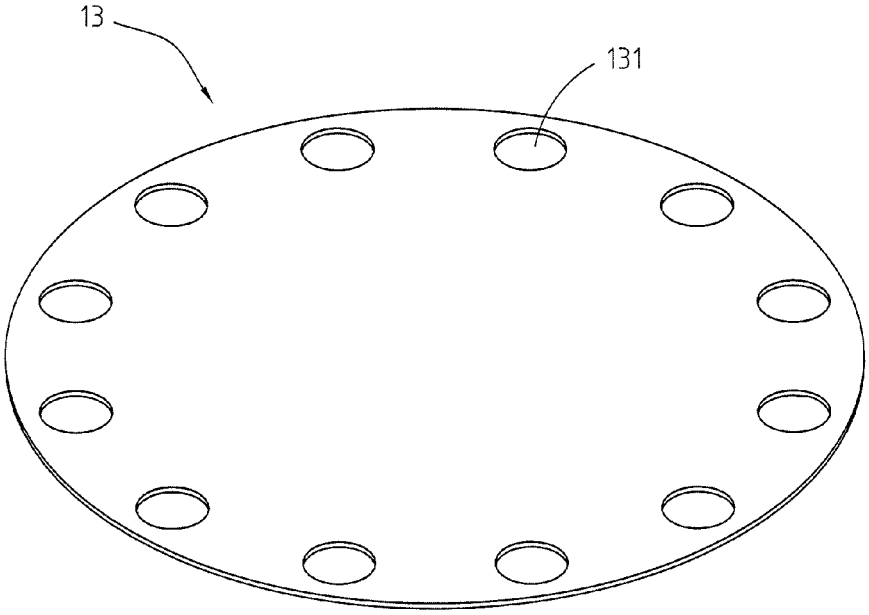
FIG. 3 is a top view of a cover of the piezoelectric ceramic dual-frequency earphone structure according to the instant disclosure.

Please refer to FIG. 3, illustrating a top view of the cover 13 of the exemplary embodiment of the piezoelectric ceramic dual-frequency earphone structure according to the instant disclosure. The cover 13 defines a plurality of sound output orifices 131 annularly arranged with an interval thereon, so that the user can feel the medium and low frequency sound are surrounded by high frequency sound.

Figure 4A:
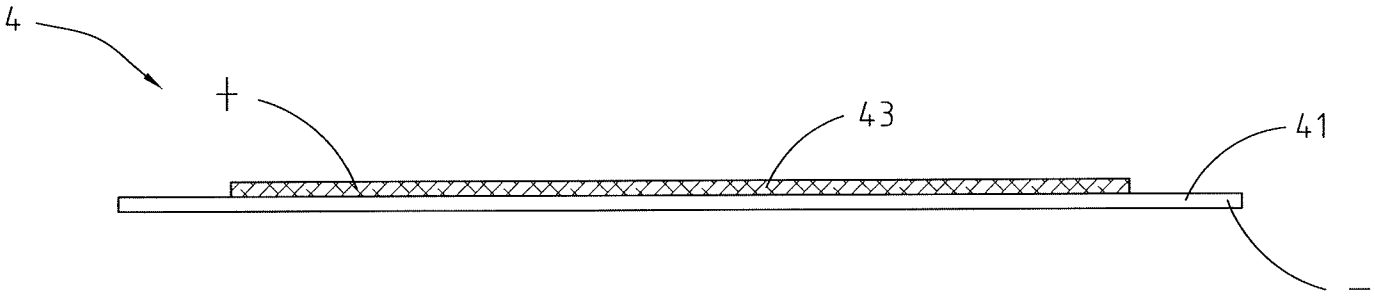
FIGS. 4A to 4B are sectional views showing several embodiments of a piezoelectric ceramic transducer of the piezoelectric ceramic dual-frequency earphone structure according to the instant disclosure.
Figure 4B:
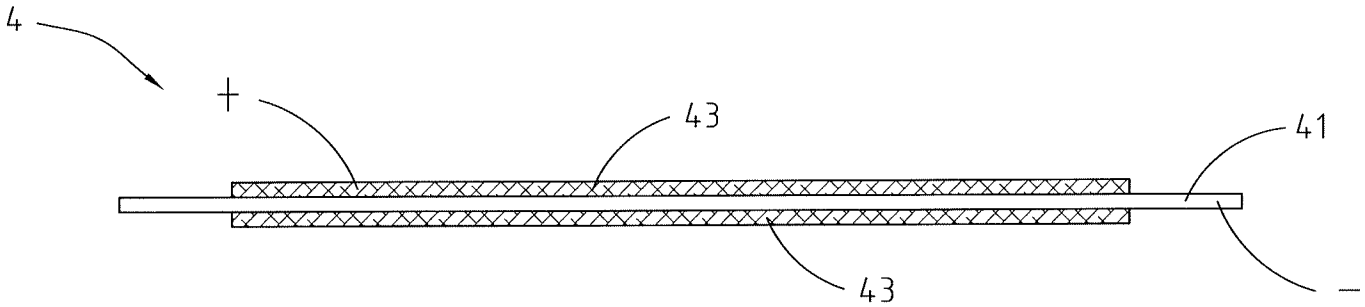

Please refer to FIG. 4A to FIG. 4B, illustrating several embodiments of the piezoelectric ceramic transducer 4 of the piezoelectric ceramic dual-frequency earphone structure according to the instant disclosure. The piezoelectric ceramic transducer 4 is a composite piezoelectric ceramic sheet comprising a metal sheet 41 and at least one ceramic membrane 43. The area of the metal sheet 41 is larger than that of each of the at least one ceramic membrane 43, and the at least one ceramic membrane 43 is disposed at a surface of the metal sheet 41 (as shown in FIG. 4A), or disposed at the two surfaces of the metal sheet 41 (as shown in FIG. 4B). When two ceramic membranes 43 are disposed at the two surfaces of the metal sheet 41, respectively, the positive terminal and the negative terminal of the acoustic signal cables 8 are respectively configured on at least one of the two ceramic membranes 43 and on the metal sheet 41.

The advantages of the instant disclosure are described as below. When electric signals are applied to the ceramic membrane of the piezoelectric ceramic transducer, the metal sheet is vibrated so as to generate high frequency sound, and the high frequency sound are then mixed with the sound from the dynamic transducer. Therefore, the piezoelectric ceramic dual-frequency earphone structure according to the instant disclosure performs clear sound resolution for high frequency bands. Furthermore, due to the medium to low frequency sound are surrounded by the high frequency sound, clear spatial resolution and orientation resolution of the sounds can be provided for the user. In addition, the piezoelectric ceramic transducer benefits the advantages of lower driving current vibrating individually, and lower cost as compared with the dynamic transducer installed in a conventional. Moreover, because the piezoelectric ceramic transducer is devoid of permanent magnet, iron scales are not absorbed thereon when used for a period. Thus, the instant disclosure performs better sound resolution, lower energy consumption and better sustainability.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A piezoelectric ceramic dual-frequency earphone structure, comprising:

an earphone housing, comprising a case and a cover, the case defining a receiving region and a sound output region, the cover connecting to the case to cover the sound output region;

a dynamic transducer installed in the receiving region, the dynamic transducer comprising a vibrating diaphragm, a vibrating member, a dynamic voice coil and a positioning unit, wherein the vibrating diaphragm comprising a central vibrating portion, a center of the vibrating member corresponding to the central vibrating portion, the dynamic voice coil configured on a lower surface of the vibrating diaphragm and sleeved with the vibrating member, the vibrating diaphragm and the vibrating member positioned on the positioning unit, the positioning unit engaged in the case, and the medium and low frequency sound generated by the vibrating diaphragm is transmitted to the sound output region;

a piezoelectric ceramic transducer installed in the receiving region, the piezoelectric ceramic transducer connected to the positioning unit via a support unit so as to connect to the dynamic transducer, wherein the dynamic transducer is located between the cover and the piezoelectric ceramic transducer, and the high frequency sound generated by the piezoelectric ceramic transducer is transmitted into the sound output region via the sides of the dynamic transducer; and a circuit board assembled in the receiving region, the circuit board is secured at the positioning unit and connected to a plurality of acoustic signal cables, so that the acoustic signal cables are connected with the dynamic voice coil and the piezoelectric ceramic transducer.

2. The piezoelectric ceramic dual-frequency earphone structure according to claim 1, wherein the positioning unit comprises a yoke assembly and a positioning base, wherein at least one latch member is configured on an inner wall of the case, the positioning base is adapted on the yoke assembly to position the vibrating diaphragm, the yoke assembly is assembled with the latch member, and the vibrating member is riveted with the yoke assembly.

3. The piezoelectric ceramic dual-frequency earphone structure according to claim 2, wherein the vibrating member comprises an annular magnet and a washer, the washer is placed on the surface of the annular magnet.

4. The piezoelectric ceramic dual-frequency earphone structure according to claim 1, further comprising a sound transmitting member riveted and connected with the vibrating member, the sound transmitting member defining a sound transmitting hole corresponding to the central vibrating portion.

5. The piezoelectric ceramic dual-frequency earphone structure according to claim 1, wherein the piezoelectric ceramic transducer is a composite piezoelectric ceramic sheet, the composite piezoelectric ceramic sheet comprises a metal sheet and a ceramic membrane, the ceramic membrane is disposed at a surface of the metal sheet, the ceramic membrane and the metal sheet are respectively connected to the positive terminal and the negative terminal of the acoustic signal cables.

6. The piezoelectric ceramic dual-frequency earphone structure according to claim 1, wherein the piezoelectric ceramic transducer is a composite piezoelectric ceramic sheet, the composite piezoelectric ceramic sheet comprises a metal sheet and two ceramic membranes, the two ceramic membranes are respectively disposed at upper and lower surfaces of the metal sheet, the positive terminal and the negative terminal of the acoustic signal cables are configured on the metal sheet and at least one of the two ceramic membranes, respectively.

7. The piezoelectric ceramic dual-frequency earphone structure according to claim 1, further comprising an acoustic signal cable guiding portion, the acoustic signal cable guiding portion is connected to and communicates with the case so as to guide the acoustic signal cables into the receiving region.

8. The piezoelectric ceramic dual-frequency earphone structure according to claim 1, further comprising a plurality of sound output orifices, the sound output orifices are annularly arranged with an interval on the cover.

9. The piezoelectric ceramic dual-frequency earphone structure according to claim 1, further comprising at least one buffer material, the buffer material is placed on at least one surface of the piezoelectric ceramic transducer to adjust the sound frequency generated from the piezoelectric ceramic transducer.

* * * * *